US007352326B2

(12) United States Patent
Korva et al.

(10) Patent No.: US 7,352,326 B2
(45) Date of Patent: Apr. 1, 2008

(54) MULTIBAND PLANAR ANTENNA

(75) Inventors: Heikki Korva, Tupos (FI); Petra Ollitervo, London (GB)

(73) Assignee: LK Products Oy, Kempele (FI)

( * ) Notice: Subject to any disclaimer, the term of this patent is extended or adjusted under 35 U.S.C. 154(b) by 175 days.

(21) Appl. No.: 10/595,607

(22) PCT Filed: Sep. 21, 2004

(86) PCT No.: PCT/FI2004/000554

§ 371 (c)(1),
(2), (4) Date: Apr. 28, 2006

(87) PCT Pub. No.: WO2005/043674

PCT Pub. Date: May 12, 2005

(65) Prior Publication Data

US 2007/0132641 A1 Jun. 14, 2007

(30) Foreign Application Priority Data

Oct. 31, 2003 (FI) ..... 20031584

(51) Int. Cl.
*H01Q 1/38* (2006.01)
*H01Q 1/24* (2006.01)
*H01Q 21/00* (2006.01)

(52) U.S. Cl. ..... 343/700 MS; 343/702; 343/728

(58) Field of Classification Search ..... 343/700 MS, 343/702, 728, 846, 873
See application file for complete search history.

(56) References Cited

U.S. PATENT DOCUMENTS

| | | | | |
|---|---|---|---|---|
| 5,363,114 | A | 11/1994 | Shoemaker | |
| 5,541,617 | A | 7/1996 | Connolly et al. | |
| 6,734,826 | B1 * | 5/2004 | Dai et al. | 343/700 MS |
| 6,897,810 | B2 * | 5/2005 | Dai et al. | 343/700 MS |
| 2004/0085244 | A1 | 5/2004 | Kadambi et al. | |

FOREIGN PATENT DOCUMENTS

| | | | |
|---|---|---|---|
| EP | 1 162 688 | A1 | 12/2001 |
| FI | 110395 | B | 9/1998 |
| WO | WO-00/36700 | A1 | 6/2000 |
| WO | WO-03/094290 | A1 | 11/2003 |

OTHER PUBLICATIONS

International Preliminary Report on Patentability for International Application No. PCT/FI2004/000554, date of issuance of report May 1, 2006.

* cited by examiner

*Primary Examiner*—Shih-Chao Chen
(74) *Attorney, Agent, or Firm*—Darby & Darby P.C.

(57) ABSTRACT

A multiband planar antenna intended for small-sized radio devices and a radio device. The basic structure of the antenna is a two-resonance P1FA, the radiating plane (320) of which has a structural part (321) corresponding to the lowest operating band and a structural part (322) corresponding to the upper operating band. In addition, a loop resonator (323) operating as a radiator is formed in the radiating plane. The ground conductor (325) of the feed line of the loop is at the same time the short-circuit conductor of the PIFA. The second conductor (326) of the feed line is connected to the opposite end of the loop, and it operates as the feed conductor of the PIFA. At the same time the structural part (321) of the radiating plane that corresponds to the lowest operating band is located between the loop and the structural part of the PIFA that corresponds to the upper operating band, in order to reduce interference between them. The resonance frequency of the loop radiator is arranged on the upper operating band of the antenna, for example. Thus the loop improves the matching of the antenna on the upper operating band and the matching and efficiency on the lowest operating band as well. This is based on additional inductance caused by the loop conductor (323) that functions as a part of the feed conductor of the PIFA.

9 Claims, 4 Drawing Sheets

MULTIBAND PLANAR ANTENNA

BACKGROUND OF THE INVENTION

The invention relates to a multiband planar antenna intended for small-sized radio devices. The invention also relates to a radio device with an antenna according to the invention.

Models that operate in two or more systems using different frequency ranges, such as different GSM systems (Global System for Mobile telecommunications) have become increasingly common in mobile stations. The basic condition for the operation of a mobile station is that the radiation and receiving properties of its antenna are satisfactory on the frequency bands of all the systems in use. This is a demanding task when the antenna is located inside the covers of the device for comfort of use.

The internal antenna of a small-sized device often has a planar structure, because then the required properties are achieved most easily. The planar antenna includes a radiating plane and a ground plane parallel with it. In order to facilitate the matching, the radiating plane and the ground plane are generally connected to each other at a suitable point by a short-circuit conductor, whereby a structure of the PIFA (planar inverted F-antenna) type is created. The number of operating bands can be increased to two by dividing the radiating plane by means of a non-conductive slot into two branches of different lengths as viewed from the short-circuit point such that the resonance frequencies corresponding to the branches are in the range of the desired frequency bands. However, in that case the matching of the antenna can become a problem. Especially making the upper operating band of the antenna sufficiently wide is difficult when it is wanted to cover the bands used by two systems. One solution is to increase the number of antenna elements: An electromagnetically coupled, i.e. parasitic planar element is placed close to the main radiating plane. Its resonance frequency is arranged e.g. close to the upper resonance frequency of the two-band PIFA so that a uniform, relatively wide operating band is formed. Naturally, a separate third operating band can be formed for the antenna with the parasitic element. The use of a parasitic element has the drawback that even a small change in the mutual location of the element and the main radiating plane deteriorates the band properties of the antenna significantly. In addition, the parasitic element requires its own short-circuit arrangement.

On the other hand, the radiating plane itself can be shaped so that it also forms a third usable resonator together with the ground plane. FIG. 1 shows an example of such a solution. There is an internal multiband planar antenna with three separate operating bands, known from the application publication FI 20011043. The antenna 100 comprises a ground plane 110 and a radiating plane 120 with a rectangular outline. At the feeding point FP the radiating plane is galvanically coupled to the antenna feed conductor and at the short-circuit point SP to a short-circuit conductor that connects the radiating plane to the ground plane. The antenna is thus of the PIFA type. The feeding point FP and the short-circuit point SP are relatively close to each other on one long side of the radiating plane. On the radiating plane 120 there is a first slot 131 starting from its edge beside the feed point and ending at the opposite side of the plane, and a second slot 132 starting from the same edge beside the short-circuit point and ending at the central area of the plane. The feeding point and the short-circuit point are between these slots. As viewed from the short-circuit point SP, the slots 131 and 132 divide the plane into a first branch 121 and a second branch 122. The first branch is dimensioned so that together with the ground plane it forms a quarter-wave resonator and operates as a radiator on the lowest operating band of the antenna. The dimensioning is facilitated by an extension E1 directed towards the ground plane and additional bends E2 arranged in the first branch which extension and bends increase the physical and electrical length of the branch. The second branch 122 is dimensioned so that together with the ground plane it forms a quarter-wave resonator and operates as a radiator on the middle operating band of the antenna. The highest operating band of the antenna is based on the second slot 132, which together with the surrounding conductor plane and the ground plane forms a quarter-wave resonator and thus operates as a slot radiator.

The conductor patterns of the radiating plane 120 have been formed on an antenna circuit board 105, in a conductor layer on its upper surface. The antenna circuit board is naturally supported at a certain height from the ground plane 110.

The structure according to FIG. 1 has the drawback that the matching of the antenna on the lowest operating band leaves room for improvement. In addition, the structure does not allow to move the middle and the highest resonance frequency close to each other for forming a uniform and serviceable, wide operating band.

FIG. 2 shows another example of an internal multiband planar antenna known from the application publication Fl 20012045. The antenna 200 comprises a ground plane 210 and a radiating plane 220 with a rectangular outline. At the feed point FP the radiating plane is galvanically coupled to the antenna feeding conductor and at the short-circuit point SP to a short-circuit conductor that connects the radiating plane to the ground plane. The feed point FP and the short-circuit point SP are relatively close to each other on one long side of the radiating plane. In the radiating plane 220 there is a first slot 231 starting from its edge between the feed point and the short-circuit point and ending at the opposite side of the plane, and a second slot 232 starting from the same edge, from the other side of the feed point as viewed from the short-circuit point.

The antenna 200 has two operating bands and three resonances that are significant with regard to its use. The radiating plane 220 has a conductor branch 221 starting from the short-circuit point SP and going round the end of the second slot 232, which together with the ground plane forms a quarter-wave resonator and operates as a radiator on the lower operating band of the antenna. The second slot 232 is located and dimensioned so that together with the surrounding conductor plane and the ground plane it forms a quarter-wave resonator and operates as a radiator on the upper operating band of the antenna. The first slot 231 is also dimensioned so that together with the surrounding conductor plane and the ground plane it forms a quarter-wave resonator and operates as a radiator on the upper operating band of the antenna. The resonance frequencies of the two slot radiators are thus arranged relatively close to each other, but different so that the upper operating band becomes relatively wide. The frequency of the resonance based on the first slot 231 has also been arranged to a suitable point by means of a conductor plate E1, which is directed from the shorter side of the radiating plane 220 closest to the short-circuit point towards the ground plane.

In this example, the radiating plane is a metal sheet supported on a certain height from the ground plane with a dielectric frame 270.

In the structure according to FIG. 2, the upper operating band of the antenna is provided with two strong and separately tunable resonances. A very broad bandwidth is thereby obtained. However, this is achieved partly at the expense of the matching on the lower operating band, which is the drawback of that solution. In very small-sized devices, the lower band matching is already difficult because of the small size of the ground plane of the device.

BRIEF SUMMARY OF THE INVENTION

The purpose of the invention is to reduce the above mentioned drawbacks of the prior art. The antenna according to the invention is characterized in what is set forth in the independent claim 1. The radio device according to the invention is characterized in what is set forth in the independent claim 9. Some preferred embodiments of the invention are set forth in the other claims.

The basic idea of the invention is the following: The antenna is a two-resonance PIFA by basic structure, the radiating plane of which has a structural part corresponding to the lowest operating band and a structural part corresponding to the upper operating band. In order to improve the properties of the antenna, a loop resonator operating as a radiator is formed in the radiating plane. The ground conductor of the feed line of the loop is at the same time the short-circuit conductor of the PIFA. The second conductor of the feed line, i.e. the feed conductor is connected to the opposite end of the loop, and it operates as the feed conductor of the PIFA at the same time. The structural part of the radiating plane that corresponds to the lowest operating band is located between the loop and the structural part of the PIFA that corresponds to the upper operating band. The resonance frequency of the loop radiator is arranged on a third operating band to be formed or on the upper operating band of the antenna in order to improve the matching.

The invention has the advantage that the structural part by which the matching of the antenna is improved on the upper operating band, also improves the matching and efficiency on the lowest operating band. This is based on the additional inductance, which the loop conductor operating as a part of the feed conductor of the PIFA introduces into it. A slight extension of the ground plane would have a similar effect, but the size of the device does not allow it. In addition, the invention has the advantage that the resonance of the loop and the upper resonance of the PIFA hardly interfere each other, in which case their frequencies can be arranged close to each other. This is due to the location of the structural part corresponding to the lowest operating band between the parts mentioned above. Furthermore, the invention has the advantage that the structure according to it does not require additional conductors, such as a second short-circuit conductor between the radiating plane and the other part of the radio device at issue.

BRIEF DESCRIPTION OF THE DRAWINGS

In the following, the invention will be described in more detail. Reference will be made to the accompanying drawings, in which.

DETAILED DESCRIPTION OF THE INVENTION

Figure 1:
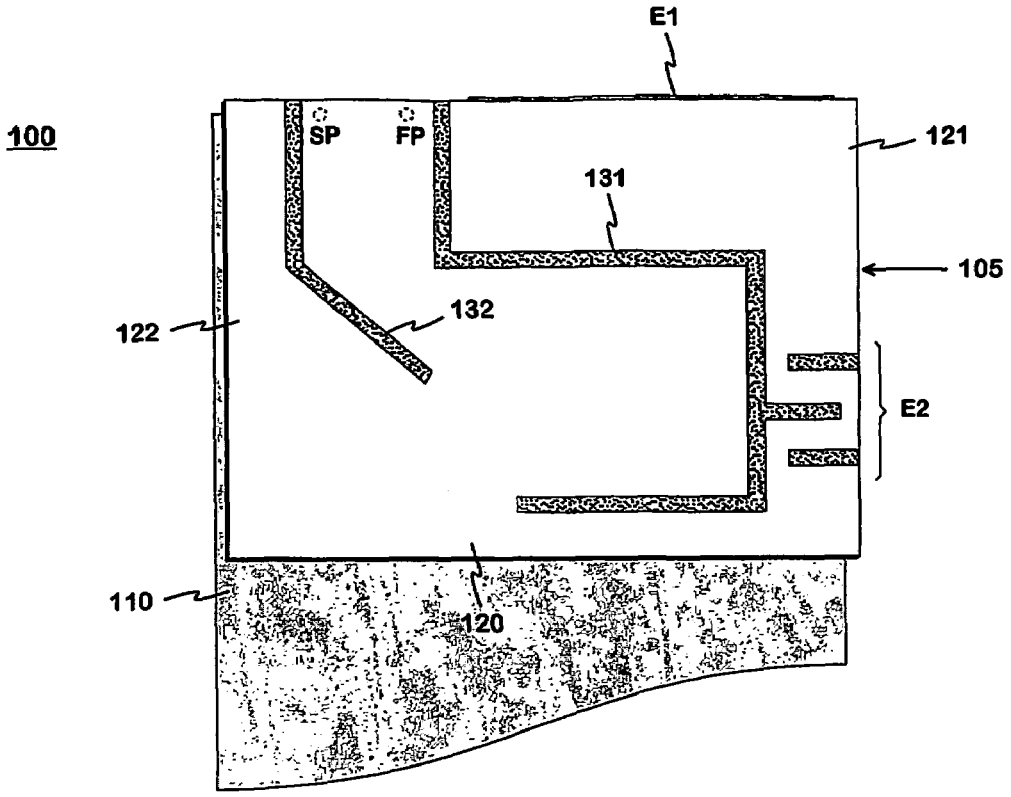
Fig. 1 PRIOR ART
FIG. 1 shows an example of a prior art multiband planar antenna.
Figure 2:
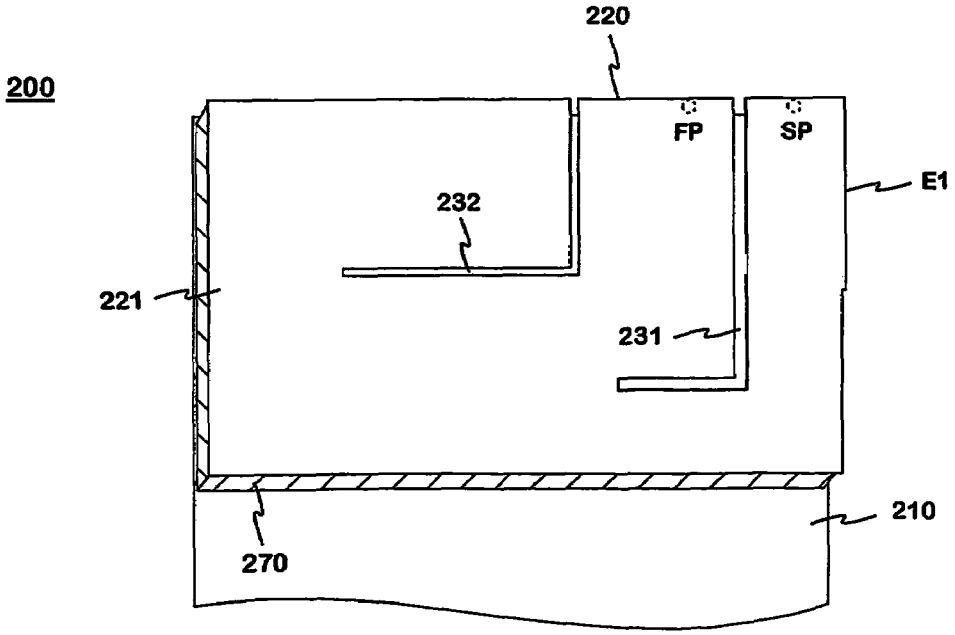
Fig. 2 PRIOR ART
FIG. 2 shows another example of a prior art multiband planar antenna.

FIGS. 1 and 2 were already discussed in connection with the description of the prior art.

Figure 3:
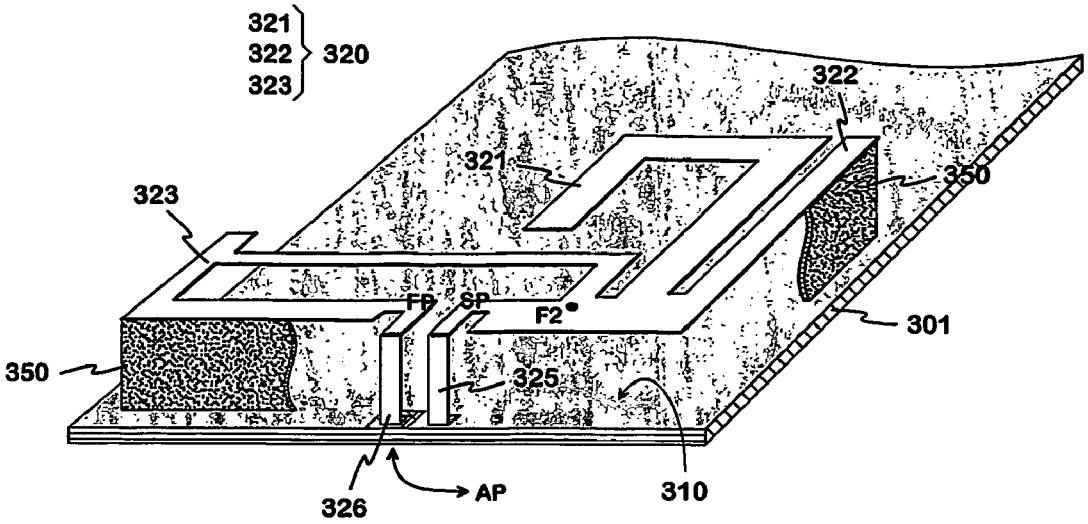
FIG. 3 shows an example of a multiband planar antenna according to the invention.

FIG. 3 shows an example of an internal multiband planar antenna according to the invention. There is a circuit board 301 of a radio device, the conductive upper surface of the circuit board functioning as the ground plane 310 of the antenna. At the one end of the circuit board, above the ground plane, there is the radiating plane 320 of the antenna. The short-circuit conductor 325, which connects the radiating plane to the ground plane, starts from an edge of the radiating plane aside which is called the front side here. The connecting point of this conductor to the radiating plane is called the short-circuit point SP. Close to the short-circuit point on the front side of the radiating plane there is the antenna feed point FP, from which the antenna feed conductor 326 starts. From the feed conductor there is through-hole with ground isolation to the antenna port AP on the lower surface of the circuit board 301. Thus, the radiating plane 320 together with the ground plane forms an antenna of the PIFA type. It has two conductor branches of different lengths as viewed from the short-circuit point SP. The lowest of the operating bands of the antenna is based on the first conductor branch 321, which extends from the short-circuit point to the opposite side of the radiating plane, continues there parallel with the opposite side and finally turns back towards the front side. The first conductor branch together with the surrounding antenna parts forms a quarter-wave resonator, which has a shorted end and an open end. The second operating band of the antenna is based at least partly on the second conductor branch 322 of the radiating plane, which extends to the opposite side of the radiating plane beside the first conductor branch, forming the end of the radiating plane. The second conductor branch together with the surrounding antenna parts forms a quarter-wave resonator, which has a shorted end and an open end.

The radiating plane 320 also comprises a conductor loop 323 located on its front side. The end points of the loop are the feed point and the short-circuit point mentioned above. Thus the loop and the PIFA have a common feed as viewed from the circuit board 301. The loop is dimensioned so that it resonates and functions as a radiator on the second operating band of the antenna or on a separate third operating band. In the former case, the second operating band can be made very wide by arranging the natural frequencies of the resonators based on the conductor loop and the second conductor branch at a suitable distance from each other. Such a tuning is possible, because the first conductor branch 321 of the radiating plane is, as described above, between the conductor loop 323 and the second conductor branch 322, in which case the coupling between the last two is relatively weak.

It was mentioned above that the feed point FP is at one end of the conductor loop 323. This means that the loop on the other hand is a relatively long extension of the feed conductor 326 of the PIFA and functions thus as a part of the entire feed conductor. When starting from the feed point FP, the loop joins the rest of the radiating plane at the starting part of the first conductor branch at a point F2, relatively close to the short-circuit point SP. The point F2 is actually the feed point of the PIFA part of the antenna. The loop conductor has a certain inductance, which is utilized in the invention. When it is a question of an antenna of a very small-sized radio device, a ground plane which would be optimal for the matching of the antenna in the frequency range of 0.9 GHz does not go in the radio device. The lowest operating band of the exemplary antenna is located on this range. The inductance of the loop conductor compensates for that deficiency in the size of the ground plane at least partly. In this way, the loop 323 improves the matching and efficiency of the antenna on the lowest operating band. The inductance is strongly dependent on the cross-sectional area of the conductor. Thus the matching of the lowest operating band can be arranged by changing the length of the inner circle of the loop conductor, when a suitable length for its outer circle with regard to the frequency of the loop resonance has been found first. Naturally, these two things have some effect on each other.

In FIG. 3 there are seen two pieces of the frame 350 that supports the radiating plane. Naturally, a larger amount of dielectric support structure is included in the whole structure so that all parts of the radiating plane remain accurately in place. The feed conductor and the short-circuit conductor of the antenna are of the same metal sheet as the radiating plane in this example. At the same time, the conductors operate as springs, and in the installed antenna their lower ends press towards the circuit board 301 by spring force.

Figure 4:
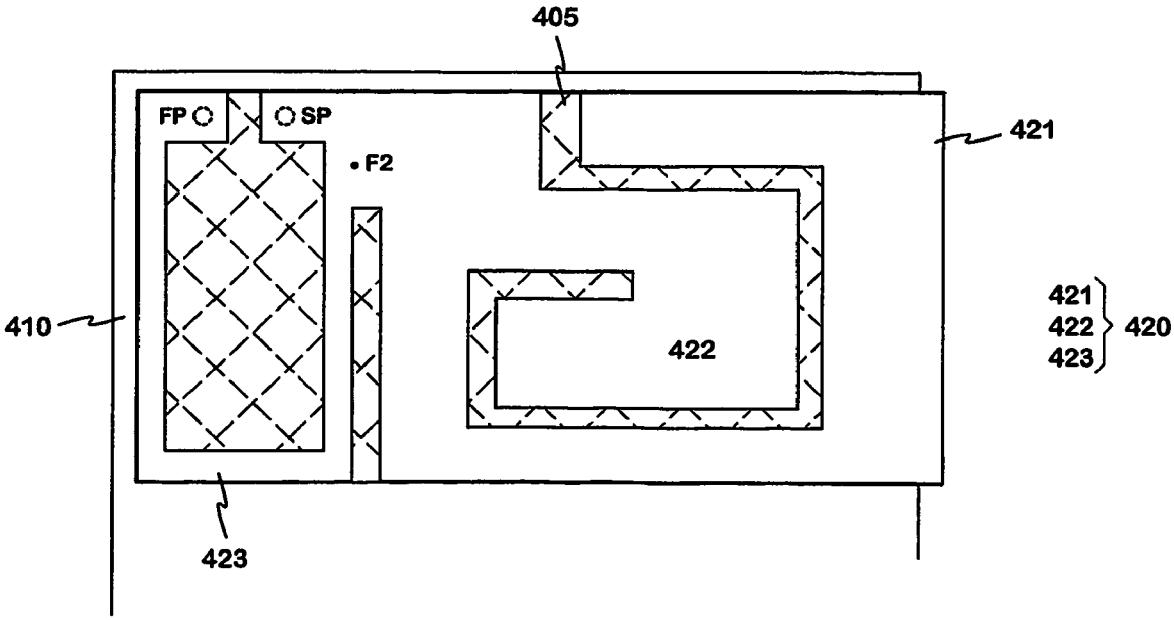
FIG. 4 shows another example of a multiband planar antenna according to the invention.

FIG. 4 shows another example of an internal multiband planar antenna according to the invention. The antenna is depicted from above, i.e. above the radiating plane. The radiating parts are now conductive areas on the upper surface of the rectangular dielectric plate 405. The ground plane 410 is shown a little below the dielectric plate. On the radiating plane 420 there are the feed point FP and the short-circuit point SP of the antenna on a long side of the plate 405. The feed point is close to a corner of the plate 405 and the short-circuit point a little further away from it. The radiating plane has a first and a second conductor branch and a loop for the same purposes as in the antenna in FIG. 3. The first conductor branch 421 extends from the short-circuit point SP to the opposite long side of the radiating plane, continues there parallel with the long side, then along the one end and further along the first mentioned long side towards the short-circuit point. The other, shorter conductor branch 422 remains in the centre of the pattern formed by the first conductor branch. The conductor loop 423 is now located at the end of the radiating plane that is on the side of the feed and short-circuit points. The loop is electrically between the feed and short-circuit points. Starting from the feed point FP, the loop joins the rest of the radiating plane at the starting part of the first conductor branch 421 at a point F2, relatively close to the short-circuit point SP. The point F2 is actually the feed point of the PIFA part of the antenna.

Figure 5:
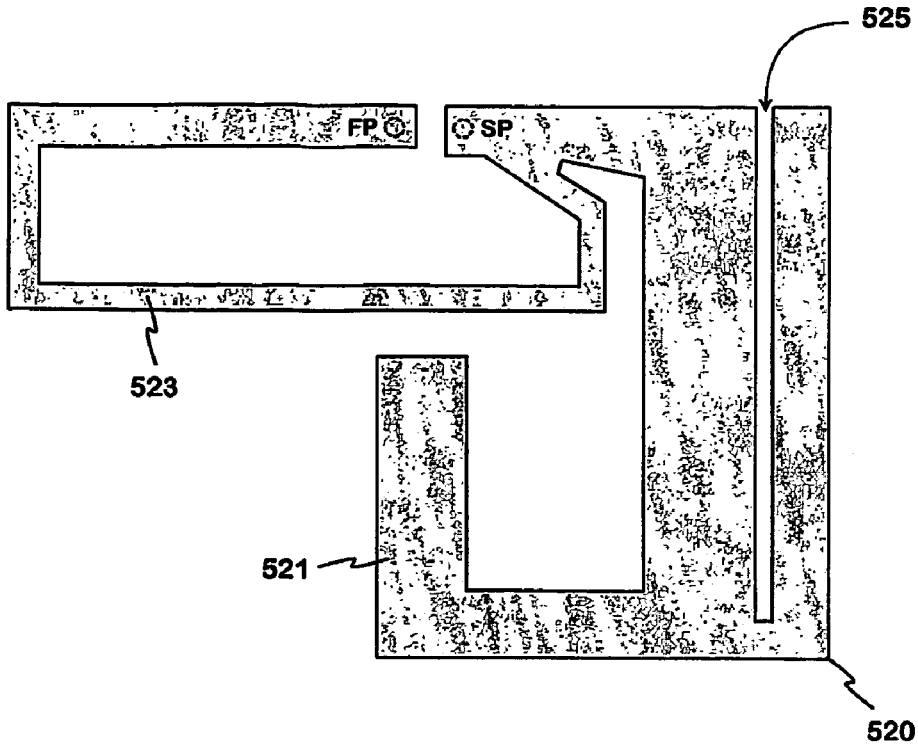
FIG. 5 shows a third example of a multiband planar antenna according to the invention.

FIG. 5 shows a third example of an internal multiband planar antenna according to the invention. The first conductor branch 521 and conductor loop 523 of the radiating plane 520 have been formed in the similar way as in the antenna of FIG. 3. The difference compared to FIG. 3 is the fact that instead of a radiator formed by the second conductor branch, there is a slot radiator at the end of the radiating plane. This slot 525 opens up to the long side of the radiator where the feed point FP and the short-circuit point SP are. The slot radiator is dimensioned to function as a quarter-wave resonator on the highest operating band of the antenna.

Figure 6:
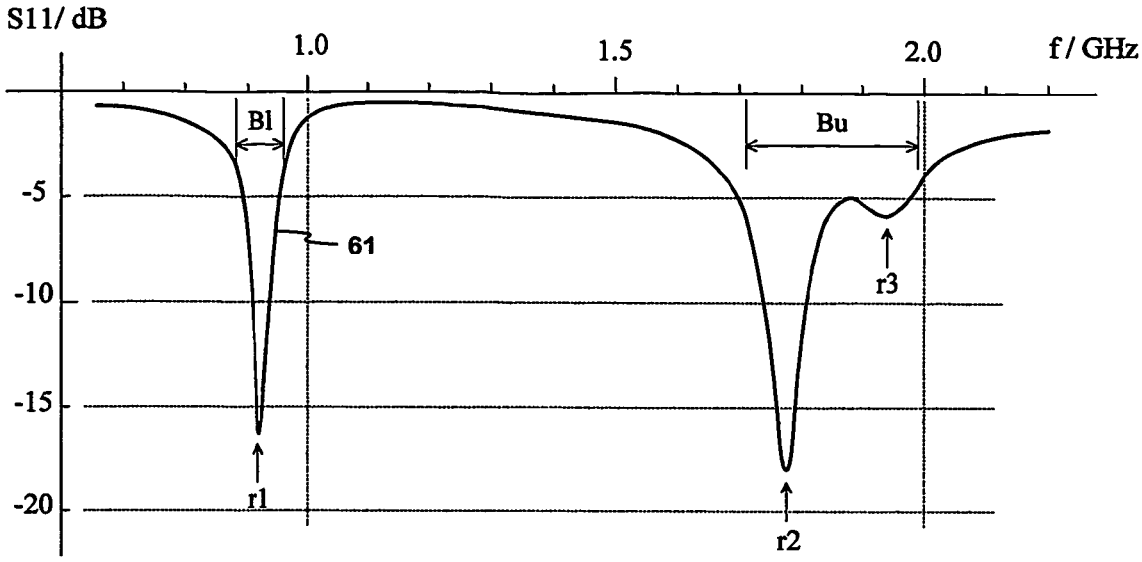
FIG. 6 shows an example of the frequency characteristics of an antenna according to the invention.

FIG. 6 shows an example of the frequency characteristics of an antenna like the one presented in FIG. 3. In the figure there is a curve 61 of the reflection coefficient S11 as a function of frequency. The measured antenna has been designed to operate in the GSM900, GSM1800 and GSM1900 systems. The band required for the first system is located in the frequency range 880-960 MHz, which is the lowest operating band B/ of the antenna. The bands required for the two latter systems are located in the frequency range 1710-1990 MHz, which is the upper operating band Bu of the antenna. From the curve it can be seen that on the edges of the lowest operating band the reflection coefficient of the antenna is approximately −3.5 dB and approximately −16 dB in the centre. On the upper operating band the reflection coefficient of the antenna fluctuates between the values −4.5 dB and −18 dB. The three significant resonances of the antenna can be seen in the shape of the curve 61. The entire lowest operating band B/ is based on the first resonance r1, which is due to the structure formed by the first conductor branch of the radiating plane together with the surrounding conductors. The upper operating band Bu is based on the second resonance r2 and the third resonance r3. The second resonance is due to the structure formed by the conductor loop of the radiating plane together with the surrounding conductors, and it is remarkably strong. The frequency of the second resonance is about 1.78 GHz. The third resonance is due to the structure formed by the second conductor branch of the radiating plane together with the surrounding conductors, and its frequency is about 1.94 GHz. The frequency characteristics of the antenna are quite good in view of the fact that the antenna has only one uniform radiator and only two contact points with the radio device.

Figure 7:
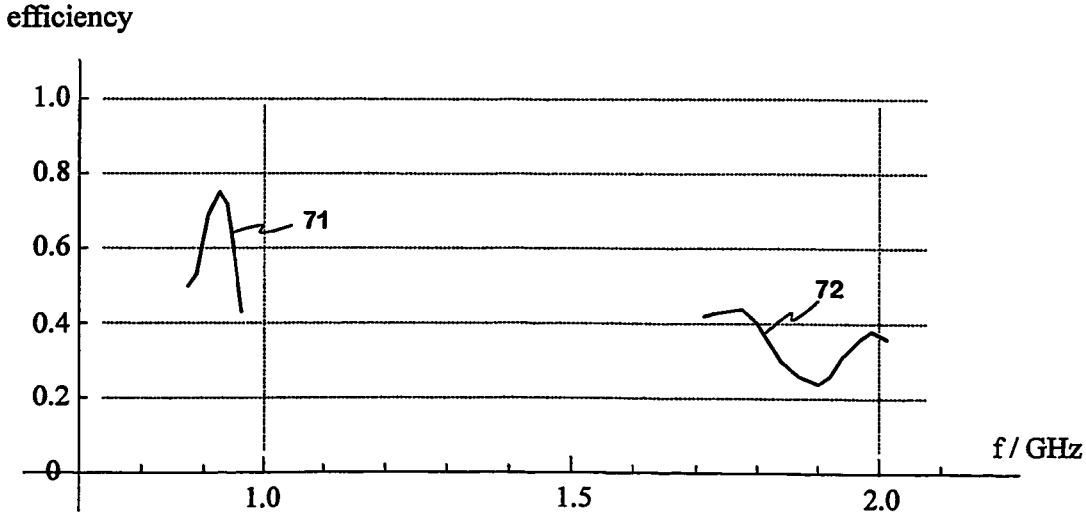
FIG. 7 shows an example of the efficiency of an antenna according to the invention.

FIG. 7 shows an example of the efficiency of an antenna according to the invention. The efficiencies have been measured from the same structure as the matching curves of FIG. 6. The curve 71 shows how the efficiency changes on the lowest operating band and curve 72 shows the same on the upper operating band. On the lowest operating band the efficiency fluctuates between 0.43-0.75 and on the upper operating band between 0.24-0.43.

The antenna gain or the relative field strength measured in the most advantageous direction in the free space fluctuates on the lowest operating band between 0.1 dB and 1.6 dB and on the upper operating band between −1.6 and +1.8 dB. The lowest antenna gain as well as the poorest efficiency are on frequencies that are not used in either of the systems GSM1800 and GSM1900.

Figure 8:
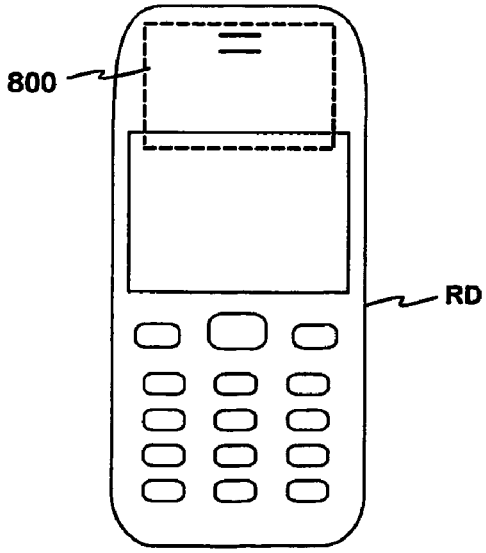
FIG. 8 shows an example of a radio device according to the invention.

FIG. 8 shows an example of a radio device according to the invention. The radio device RD has an internal multiband planar antenna 800 according to the above description, marked with a dashed line in the figure.

In this description and the claims, the qualifier "close" means in a distance which is relatively small compared to the width of the planar antenna, in the order of less than a tenth of the wavelength that corresponds to the highest usable resonance frequency of the antenna.

Multiband antennas according to the invention have been described above. The shape of the antenna radiator can naturally differ from those described, and the invention does not limit the manufacturing method of the antenna. The inventive idea can be applied in different ways within the scope defined by the independent claims 1 and 9.

The invention claimed is:

1. A multiband planar antenna having at least a lowest operating band and a second operating band and comprising a ground plane (310, 410) and a radiating plane (320; 420; 520), which is at a feeding point (FP) connected to an antenna port of the radio device and at a short-circuit point (SP) to the ground plane, which radiating plane comprises a first conductor branch and a second part such that the first conductor branch (321; 421; 521) together with the surrounding antenna parts forms a quarter-wave resonator shorted at the short-circuit point, a natural frequency of which resonator is located on the lowest operating band, and the second part (322, 422, 525) together with the surrounding antenna parts forms a resonator, a natural frequency of which is located on the second operating band, characterized in that the radiating plane further comprises a conductor loop (323, 423, 523) starting from the feeding point (FP), joining the rest of the radiating plane close to the short-circuit point and ending at the short-circuit point (SP) for forming a loop radiator and for improving antenna matching on the lowest operating band, and a part of the first conductor branch of the radiating plane is located between the conductor loop and said second part.

2. A planar antenna according to claim 1, characterized in that the second part of the radiating plane is a conductor branch (322; 422) starting from the short-circuit point.

3. A planar antenna according to claim 1, characterized in that the second part of the radiating plane is a non-conductive slot (525) starting from an edge of the plane that is on the side of the feed and short-circuit point for forming a slot radiator, which resonates in the range of the second operating band.

4. A planar antenna according to claim 1, characterized in that the natural frequency of the resonator based on said conductor loop (323) is on the second operating band in order to widen it.

5. A multiband antenna according to claim 1, further having a third operating band, characterized in that the natural frequency of the resonator based on said conductor loop is on the third operating band.

6. A planar antenna according to claim 1, characterized in that said improving of the antenna matching on the lowest operating band is arranged by choosing the width and thus the inductance of the conductor (323) of the conductor loop, which conductor functions as an extension of the antenna feeding conductor (326).

7. A planar antenna according to claim 1, characterized in that the radiating plane (320) is a piece of sheet metal.

8. A planar antenna according to claim 1, characterized in that the radiating plane (420) is a conductive area on a surface of a dielectric plate (405).

9. A radio device (RD) having at least a lowest operating band and a second operating band and a multiband planar antenna (800) which comprises a ground plane and a radiating plane being a at a feed point connected to an antenna port of the radio device and at a short-circuit point to the ground plane, which radiating plane comprises a first conductor branch and a second part such that the first conductor branch together with the surrounding antenna parts forms a quarter-wave resonator shorted at the short-circuit point, a natural frequency of which resonator is located on the lowest operating band, and the second part together with the surrounding antenna parts forms a resonator, a natural frequency of which is located on the second operating band, characterized in that the radiating plane further comprises a conductor loop starting from the feed point, joining the rest of the radiating plane close to the short-circuit point and ending at the short-circuit point for forming a loop radiator and for improving the antenna matching on the lowest operating band, and a part of the first conductor branch is located between the conductor loop and said second part.

* * * * *